US009242480B2

(12) United States Patent
Hiramatsu et al.

(10) Patent No.: US 9,242,480 B2
(45) Date of Patent: Jan. 26, 2016

(54) LIQUID EJECTING APPARATUS AND LIGHT SOURCE MODULE

(71) Applicant: SEIKO EPSON CORPORATION, Tokyo (JP)

(72) Inventors: Kazunori Hiramatsu, Okaya (JP); Hiroaki Sakai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/510,810

(22) Filed: Oct. 9, 2014

(65) Prior Publication Data

US 2015/0109363 A1 Apr. 23, 2015

(30) Foreign Application Priority Data

Oct. 22, 2013 (JP) ..... 2013-219372

(51) Int. Cl.
*B41J 11/00* (2006.01)
*B41J 2/07* (2006.01)
*B41J 29/38* (2006.01)

(52) U.S. Cl.
CPC *B41J 11/002* (2013.01); *B41J 2/07* (2013.01); *B41J 29/38* (2013.01)

(58) Field of Classification Search
CPC .... B41J 11/008; B41J 11/0095; B41J 11/002; B41J 2/07; B41J 29/38
See application file for complete search history.

(56) References Cited

U.S. PATENT DOCUMENTS

2009/0167794 A1 7/2009 Hosono et al.
2015/0124017 A1* 5/2015 Aoyama ..... B41J 11/002 347/16

FOREIGN PATENT DOCUMENTS

| | | |
|---|---|---|
| JP | 2005-254560 | 9/2005 |
| JP | 2009-160920 | 7/2009 |
| JP | 2012-025116 | 2/2012 |
| JP | 2013-043310 | 3/2013 |

* cited by examiner

*Primary Examiner* — Thinh Nguyen
(74) *Attorney, Agent, or Firm* — Workman Nydegger

(57) ABSTRACT

A printer includes a light source module including an ejecting head that ejects a UV ink onto a medium. The UV ink hardens when irradiated with a UV light ray. The light source module includes an irradiator that irradiates the UV ink with the UV light ray. The printer may include a guide shaft to/from which the light module is attachable/detachable and a driving controller that performs control of the irradiator. The light source module includes, in addition to the irradiator, a memory module that stores therein information indicating a light irradiation feature of the irradiator. The driving controller performs control of the irradiator by using the information indicating a light irradiation feature of the irradiator.

6 Claims, 5 Drawing Sheets

LIQUID EJECTING APPARATUS AND LIGHT SOURCE MODULE

CROSS-REFERENCE TO RELATED APPLICATIONS

The present application claims priority to Japanese Patent Application No. 2013-219372, filed Oct. 22, 2013, which is hereby incorporated by reference in its entirety.

BACKGROUND

1. Technical Field

Embodiments of the present invention relate to a liquid ejecting apparatus that ejects a light hardening liquid onto a medium, and that hardens the liquid that has been ejected on the medium by irradiating the liquid with a light ray. Embodiments further relate to a light source module that is attachable to the liquid ejecting apparatus.

2. Related Art

An ink jet printer is an example of liquid ejection apparatus that performs printing by ejecting an ink onto paper through nozzles formed in an ejecting head and is known. A printer that ejects an ultraviolet (hereinafter, also referred to as "UV") hardening ink, which hardens when irradiated with a UV ray or UV radiation, is also known (refer to, for example, JP-A-2009-160920).

In this printer, a UV light source is attached at both edges of an ejecting head. When an image or the like is printed on a medium, a UV hardening ink is ejected towards the medium through nozzles which are provided in the ejecting head. When the UV hardening ink, which has adhered to the medium, is irradiated with a UV ray, the UV hardening ink promptly hardens on the medium.

In addition, in a printer provided with such a UV light source, there is a case where it becomes difficult to ensure that an amount of light necessary to harden the UV hardening ink is delivered because of a degradation of the UV light source. For this reason and when necessary, maintenance work is carried out, for example by replacing the UV light source.

Meanwhile, even though UV light sources are manufactured so as to comply with the same specification, differences sometimes occur among their respective light irradiation features due to variation in manufacturing processes. Further, when an existing UV light source is replaced by a new UV light source and their specifications are different from each other, their light irradiation features are also different from each other. Thus, even when a driving electric current of the same amount is caused to flow through a light source before and after a replacement of the light source, a variation sometimes occurs in an amount of irradiated light. In other words, the amount of irradiated light emitted by a light source that replaces an older light source may be different even though the specification of the two light sources are the same and even when the same driving electric current is used.

The printer may include an information storage portion. The information storage portion may retain or store programs executed by a control device of the printer as well as various kinds of information necessary for the control performed by the control device. The information storage portion may also retain or store control data adapted to a light irradiation feature of a light source which was attached in the printer at the time when various kinds of information was stored into the information storage portion last time. For this reason, replacement of a UV light source causes a new UV light source to be controlled on the basis of control data adapted to a previous UV light source. Thus, it is likely to be difficult to appropriately perform control of an amount of light irradiated from the new UV light source.

Thus, after a UV light source is replaced in a maintenance work, control data for a light source, which control data has been retained in the control device, is updated by actually driving the new light source and learning a light irradiation feature of the new light source after the replacement. Nevertheless, there is problem that, when such an update operation needs to be performed, a period of time required for the maintenance work becomes long.

In addition, such a problem is not limited to an ink jet printer which performs printing using a UV hardening ink, but is mostly common to liquid ejecting apparatuses each ejecting a light hardening ink.

SUMMARY

An advantage of some embodiments of the invention is to provide a liquid ejecting apparatus which shortens a period of time required for a maintenance work of replacing a light source as well as a light source module attachable to the liquid ejecting apparatus.

Hereinafter, means for realizing such a liquid ejecting apparatus and a light source module as well as behavior effects brought by the means will be described. A liquid ejecting apparatus that can deliver an appropriate amount of radiation even when a light source is replaced with a new light source is described.

A liquid ejecting apparatus according to an embodiment of the invention includes an ejecting head that ejects a liquid, a light source module including a light source that irradiates light and a storage medium that stores therein information indicating a light irradiation feature of the light source, an attaching portion to/from which the light source module is attachable/detachable, and a controller that performs control of the light source by using the information indicating a light irradiation feature and that is stored in the storage medium.

According to the aforementioned configuration, when a light source is replaced, the light source module is detached from the attaching portion, and a new light source module is attached to the attaching portion. The light source module may be handled as a replacement unit and may include a light source as well as a storage medium which stores therein information indicating a light irradiation feature of the light source. Thus, even when there is an individual difference and/or a specification difference between a previous light source and a new light source after the replacement or after the maintenance work, it becomes unnecessary to cause the controller to update its own control data by actually driving the new light source to learn a light irradiation feature of the new light source. Accordingly, it becomes possible to shorten a period of time necessary to perform a maintenance work related to a replacement of a light source.

Further, in the liquid ejecting apparatus, when the storage medium included in the light source module is called a first storage medium, the controller is provided with a second storage medium, makes a copy of the information, which indicates a light irradiation feature of the light source and which is stored in the first storage medium, into the second storage medium, and performs control of the light source on the basis of the information that has been copied into the second storage medium.

According to the aforementioned configuration, under a state where the information stored in the first storage medium included in the light source module is copied in the second storage medium included in or accessible by the controller, the controller performs control on the basis of the copied information. Thus, every time the controller performs control of or controls the light source, the controller does not need to read out the information indicating a light irradiation feature from the light source module which is installed separately from the controller. Thus, even when the information is difficult to be read out from the first storage medium due to, for example, an interruption of communication between the first storage medium and the controller, the controller can appropriately perform control of the light source on the basis of the information which is copied in the second storage medium. Accordingly, it becomes possible to improve the reliability of control of a light source or to control the light source with more reliability Further, in one embodiment of the aforementioned liquid ejecting apparatus, the controller makes a copy of the information stored in the first storage medium into the second storage medium at a time point when the light module is attached.

Since the temperature of the light source becomes high when the light source is in a driven state, the first storage medium included in the light source module is exposed to high temperatures. As a result, the operation of reading out the information from the first storage medium is likely to be subjected to trouble due to the influence of heat caused by the high temperatures.

In this regard, in the aforementioned configuration, at the time of the attachment of the light source module, that is, before the first storage medium is exposed to high temperatures associated with driving the light source, the information stored in the first storage medium is copied into the second storage medium. When a light source is replaced with a new light source, the information stored in the first storage medium is highly reliable. Thus, after replacing the light source, the information can be copied into the second storage medium before the first storage medium is exposed to high temperatures and the copied information is highly reliable. Accordingly, it becomes possible to further improve the reliability of control of or of controlling a light source.

Further, in one embodiment of the liquid ejecting apparatus, the storage medium included in the light source module is provided with a storage area for use in determining a malfunction of the storage medium.

When the storage medium becomes in or enters a malfunction state, appropriate control of the light source is likely difficult to perform.

In this regard, according to the aforementioned configuration, the storage area for use in determining a malfunction of the storage medium is provided in the storage medium included in the light source module. Thus, it becomes possible to determine whether or not the storage medium is in a malfunction state on the basis of information stored in the storage area. Further, only when the storage medium is not in the malfunction state, through control of the light source based on the information stored in the storage medium, it becomes possible to prevent the light source from being controlled on the basis of erroneous information. Moreover, in the case where the information stored in the storage module included in the light source module is copied into the storage medium included in the controller only when the storage medium included in the light source module is not in the malfunction state, it becomes possible to prevent the light source from being controlled on the basis of erroneous information. Accordingly, it becomes possible to further improve the reliability of control of or of controlling a light source.

Further, a light source module according to one embodiment includes a light source that irradiates light, and a storage medium that stores therein information indicating a light irradiation feature of the light source.

According to this configuration, the light source and the storage medium which stores therein the information indicating a light irradiation feature of the light source are configured as a unified light source module. Thus, even when there is an individual difference and/or a specification difference between a previous light source being replaced and a new light source, it is possible to, through operation of reading out the information stored in the storage medium of the light source module, grasp a light irradiation feature of the new light source included in the light source module. Further, at the time of the attachment of such a light source module into the liquid ejecting apparatus, it becomes possible to, through an operation of reading out the information indicating a light irradiation feature of a light source included in the attached light source module from a storage medium included in the attached light source module, appropriately perform control of the light source.

That is, at the time of a replacement of a light source, it is possible to, without actual driving od a light source after the replacement, grasp or obtain a light irradiation feature of the light source in the new light source module. Accordingly, it becomes possible to shorten a period of time necessary to perform a maintenance work of replacing a light source.

Further, in the light source module, the storage medium is provided with a storage area for use in determining a malfunction of the storage medium or in determining or identifying a malfunction state.

When the storage medium becomes in or enters a malfunction state, appropriate control of the light source is likely difficult to performed.

In this regard, in the aforementioned configuration, the storage area for use in determining a malfunction of the storage medium is provided in the storage medium included in the light source module. Thus, it becomes possible to determine whether or not the storage medium is in a malfunction state on the basis of information stored in the storage area. In addition, at the time of the attachment of such a light source module into the liquid ejecting apparatus and only when it has been determined that there no malfunction occurs in the storage medium, control of a light source may be performed on the basis of information stored in the storage medium and it becomes possible to perform appropriate control of the light source. Accordingly, embodiments prevent erroneous information from being used to control a light source. Thus, it becomes possible to further improve the reliability of control of a light source.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, an embodiment of a liquid ejecting apparatus as well as a light source module attachable to the liquid ejecting apparatus will be described with reference to FIGS. 1 to 4. In addition, this embodiment will be described by way of an example in which the liquid ejecting apparatus is embodied by an ink jet printer (hereinafter, referred to as just a "printer").

Figure 1:
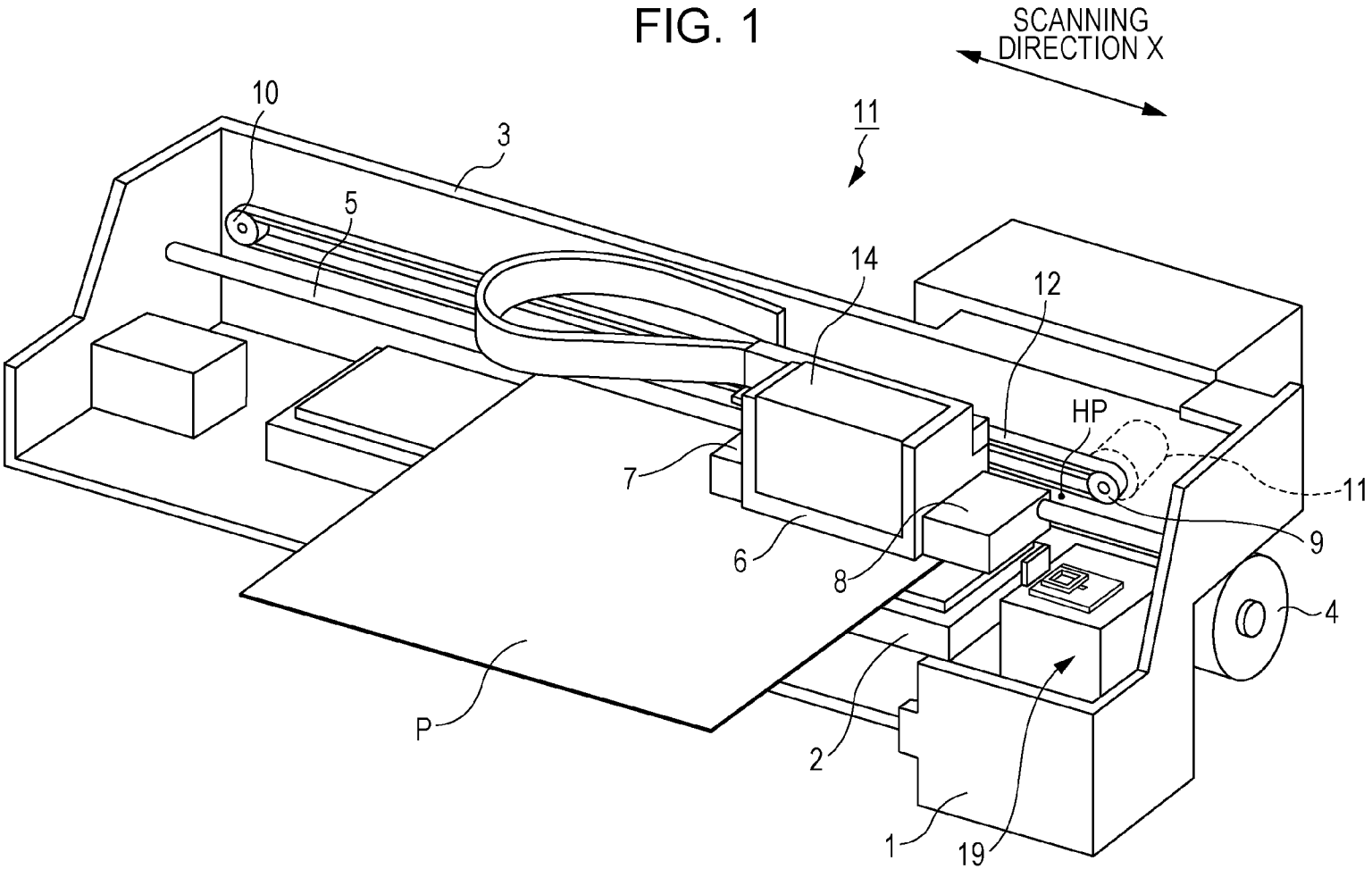
FIG. 1 is a perspective view of an embodiments of a printer.

As shown in FIG. 1, the ink jet printer includes a substantially rectangular shaped body case 1. The body case 1 is provided, in a lower portion thereof, with a supporting table 2 extending along the longitudinal direction of the body case 1. Further, a paper feeding motor 4 is arranged below a rear wall 3 of the body case 1. When the feeding motor 4 is driven, paper P, which is an example of a medium, is transported onto the supporting table 2.

Further, a guide shaft 5 is provided above the supporting table 2. The guide shaft 5 is installed across the body case 1 so as to extend in the longitudinal direction of the body case 1. There a carriage 6 which is attached to the guide shaft 5 is provided so as to slidably move along a shaft direction of the guide shaft 5. Further, a first light source module 7 and a second light source module 8, each of which is attached to a corresponding one of both sides of the carriage 6 are provided. Both sides of the carriage intersect with a shaft direction of the guide shaft 5. The first and second light source modules are arranged so as to interpose the carriage 6 therebetween. In addition, the light source modules 7 and 8 are detachable from the carriage 6. The carriage 6 functions as an attaching portion thereof. The light source modules 7 and 8 are installed so as to slidably move along the shaft direction of the guide shaft 5 together with the carriage 6.

Inside the rear wall 3 of the body case 1, a driving pulley 9 and a driven pulley 10 are each provided so as to freely rotate at a corresponding one of both longitudinal-direction edge portions of the body case 1. The driving pulley 9 is joined with a driving motor 11 for rotating the driving pulley 9 itself. With respect to the driving pulley 9 and the driven pulley 10, an endless timing belt 12, part of which is joined with the carriage 6, is wounded around the driving pulley 9 and the driven pulley 10. Thus, the rotation of the driving pulley 9, made by the driving motor 11, causes the carriage 6 and the light source modules 7 and 8 to move along the shaft direction of the guide shaft 5 via the timing belt 12. In addition, hereinafter, this movement direction of the carriage 6 will be referred to as a scanning line X.

Next, the carriage 6 and the light source modules 7 and 8 will be described together with reference to FIG. 2.

Figure 2:
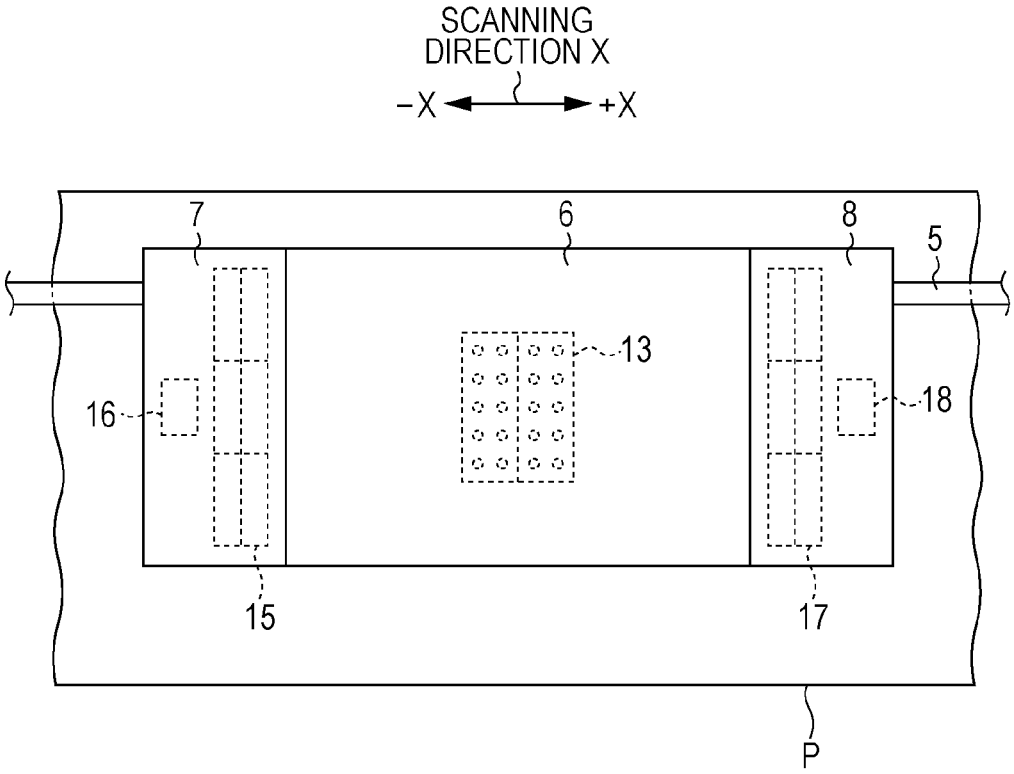
FIG. 2 is a top view illustrating an outline of a configuration of an example of a carriage and an example of a light source module which are included a printer.

As shown in FIG. 2, an ejecting head 13 is provided on a lower face of the carriage 6. The ejecting head 13 is configured to eject a UV hardening ink (hereinafter, also referred to as a "UV ink"), which is an example of a light hardening liquid. Further, as shown in FIG. 1, an ink cartridge 14 for supplying the ejecting head 13 with a UV ink is attached to the carriage 6 so as to be attachable/detachable to/from the carriage 6. The UV ink contained inside the ink cartridge 14 is supplied to the ejecting head 13 in conjunction with a driving operation of a piezoelectric element included in the ejection head 13. Further, the UV ink supplied to the ejection head 13 is ejected onto the paper P that has been transported onto the supporting table 2 through a plurality of nozzles which are formed in the ejecting head 13.

Further, the first light source module 7 is provided with or includes an irradiator 15 which irradiates a UV light ray as well as a memory module 16. The irradiator 15 is an example of a light source and the memory module 16 is an example of a storage medium. The memory module 16 may be an involatile memory module, and stores therein a module of information indicating a light irradiation feature of the irradiator 15. In one embodiment, as pieces of elemental information included in the module of information indicating a light irradiation feature, relations between amounts of light irradiated from the irradiator 15 at the time when various amounts of electric current are provided into or delivered to the irradiator 15 and the amounts of the electric current are stored. In one example, the information includes relationships between currents and corresponding amounts of irradiated light. Further, the irradiator 15 and the memory module 16 may be arranged on the same substrate.

The second light source module 8 may be provided with an irradiator 17 which irradiates a UV light ray as well as a memory module 18. The irradiator 17 is an example of a light source and the memory module is an example of a storage medium. The memory module 18 may be an involatile memory module, and stores therein a module of information indicating a light irradiation feature of the irradiator 17. In one embodiment, as pieces of elemental information included in the module of information indicating a light irradiation feature, relations between amounts of light irradiated from the irradiator 17 at the time when various amounts of electric current are provided into or delivered to the irradiator 17 and the amounts of the electric current are stored. In one example, the information includes relationships between currents and corresponding amounts of irradiated light. Further, these irradiator 17 and memory module 18 are arranged on the same substrate.

In addition, the memory module 16 (18) may function as a storage medium in which a light irradiation feature of the irradiator 15 (17) functioning as a light source is stored.

Further, a metal halide lamp, a UV-LED or the like can be employed as the irradiator 15 (17).

In FIG. 2, a direction extending in a right-hand direction is denoted by "scanning direction +X", and a direction extending in a left-hand direction is denoted by "scanning direction −X". When the carriage 6 moves in the "scanning direction +X", a UV light ray is irradiated from the irradiator 15 which is located backward in a direction of the movement of the carriage 6. Thus, the irradiator 15 follows the carriage 6. Meanwhile, when the carriage 6 moves in the "scanning direction −X", a UV light ray is irradiated from the irradiator 17 which is located backward in a direction of the movement of the carriage 6. Thus, the irradiator 17 follows the carriage 6 when irradiating light. Accordingly, when a UV ink is caused to be ejected towards the paper P, this UV ink is ejected in conjunction with the movement of the carriage 6 and adheres to the paper P. As a result, the UV ink in the state of being adhered to the paper P is irradiated with the UV light ray and becomes hardened immediately.

Further, as shown in FIG. 1, the body case 1 is provided therein with a maintenance mechanism 19 at a right-hand edge portion shown in FIG. 1. This maintenance mechanism 19 is configured to, when the carriage 6 and the light source modules 7 and 8 have reached a home position HP which is located at a position closest to the driving pulley 9, perform maintenance operations. The maintenance operations may include cleaning the ejecting head 13 and measuring light amounts of UV light rays irradiated from the irradiators 15 and 17. In addition, when it is determined through these maintenance operation that, for example, the light amount of the UV light ray irradiated from the irradiator 15 (or 17) is less than a light amount required for hardening the UV ink, the maintenance mechanism 19 outputs a signal. The signal notifies a user of the need to replace the first light source module 7 and/or the second light source module 8.

Next, an example of an electrical configuration of the printer will be described with reference to FIG. 3.

Figure 3:
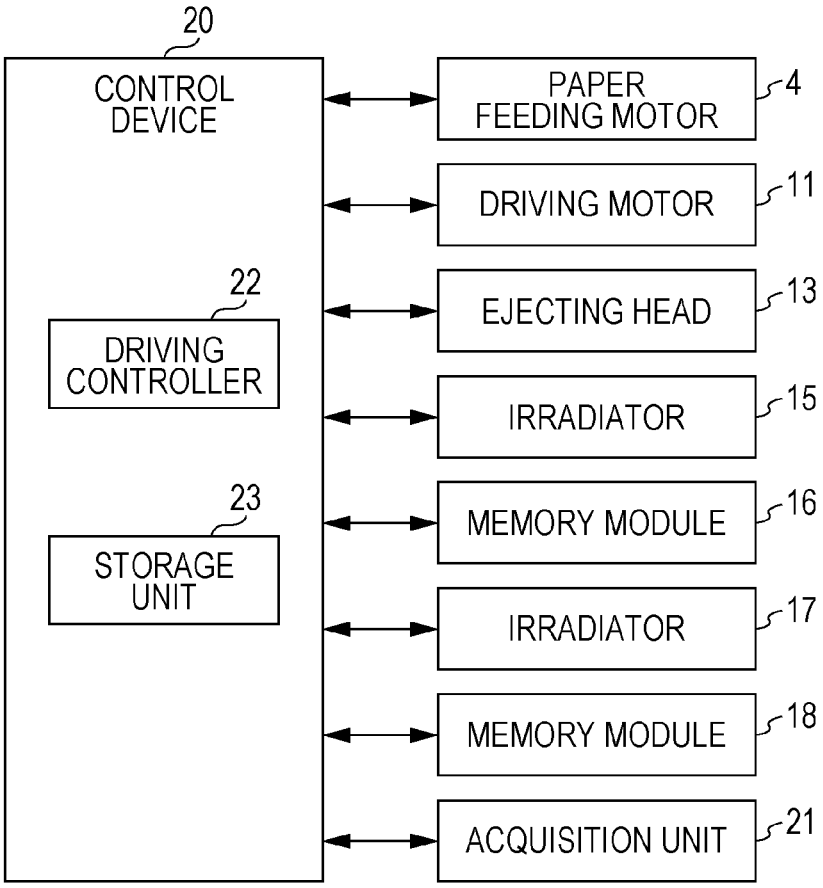
FIG. 3 is a block diagram schematically illustrating an embodiments of an electric configuration of a printer\.

As shown in FIG. 3, the printer may be provided with a control device 20 for performing overall control of the printer itself. This control device 20 is electrically connected to individual constituent components of the printer. Such constituent components include, for example, the paper feeding motor 4, the driving motor 11, the ejecting head 13, the irradiator 15, the memory module 16, the irradiator 17, the memory module 18, an acquisition unit 21 and the like. This acquisition unit 21 is a unit for acquiring pieces of information related to a kind of ink and a kind of medium, and may be, for example, a liquid crystal display of a touch panel type or a computer electrically connected to the printer itself. The control device 20 receives electric signals inputted from these individual constituent components.

Further, the control device 20 includes a driving controller 22 and a storage unit 23. This storage unit 23 may be constituted of a nonvolatile memory module and may store therein various programs for printer control. Further, the driving controller 22 performs various arithmetic operations for printer control on the basis of the electric signals inputted from the individual constituent components, and performs control of the individual constituent components on the basis of the results of the arithmetic operations. The control performed by the driving controller 22 may include, for example, control of a printing speed, control of a quality of a printed image, and the like. Further, the driving controller 22 performs light source control for controlling the amounts of electric currents flowing through the irradiators 15 and 17. The driving controller 22 can adjust the light amounts of UV light rays irradiated from the irradiators 15 and 17. That is, in this printer, the driving controller 22 functions as a control unit which performs control of the irradiators 15 and 17 which are examples of light sources.

Next, an example of the light source control performed by the driving controller 22 will be described with reference to FIG. 4. In addition, light source control on the irradiator 15 included in the first light source module 7 is the same as light source control on the irradiator 17 included in the second light source module 8 (even if the specifications are not the same for the two light sources). For this reason, hereinafter, this description will be made by exemplifying the light source control on the irradiator 15, and description of the light source control on the irradiator 17 will be omitted.

The memory module 16 included in the first light source module 7 stores therein a module of control data for use in control of the irradiator 15. In one example, the module of information indicates or includes a light irradiation feature of the irradiator 15. The light irradiation features include an amount of irradiated light corresponding to different amounts of current.

Figure 4:
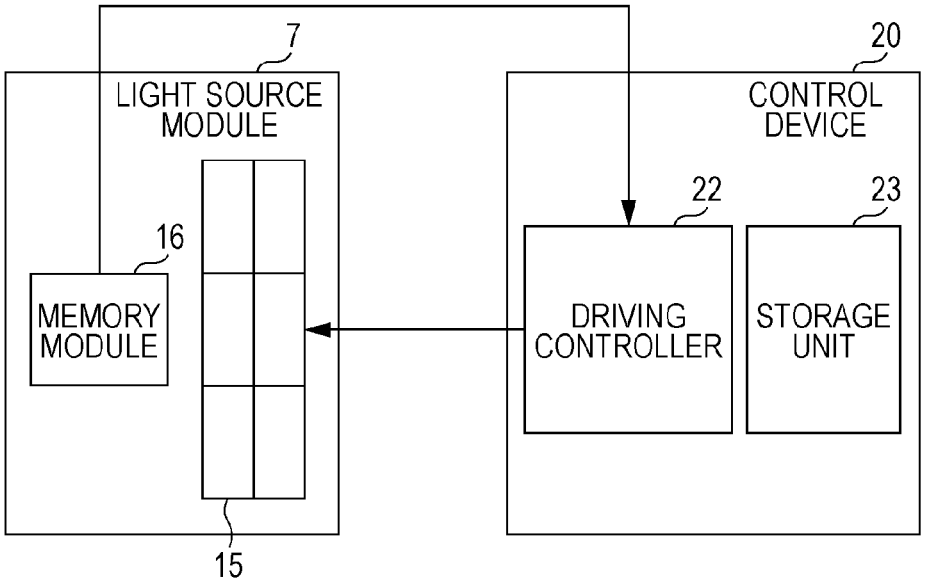
FIG. 4 is a block diagram schematically illustrating an example of a light source in a printer.

Thus, as indicated by arrows in FIG. 4, the driving controller 22 included in the control device 20 reads out the module of information indicating a light irradiation feature of the irradiator 15 from the memory module 16 included in the first light source module 7 at predetermined intervals. Further, the driving controller 22 performs control of or controls the irradiator 15 by using this module of information. That is, the driving controller 22 grasps or retrieves the light irradiation feature of the irradiator 15 by reading out the module of information stored in the memory module 16. Further, the driving controller 22 performs control of electric current provided into or delivered to the irradiator 15 in accordance with the light irradiation feature having been obtained as described above so that an amount of light necessary to harden the UV ink can be ensured and can be irradiated.

Next, actions of a printer according to one embodiment will be described.

In one embodiment, the first light source module 7, which is detachable and is provided with the irradiator 15, is employed. Thus, the replacement of the irradiator 15, which is a light source, is completed by detaching the first light source module 7 from the carriage 6 of the printer and attaching a new light source module 7 to the carriage 6. Further, this new first light source module 7 is provided with the memory module 16 in which a module of information indicating a light irradiation feature of a new irradiator 15 included in the new first light source module 7 is stored. Thus, it is possible to, without actually driving the new irradiator 15 after the old irradiator or light source module is replaced with the new light source module to learn a light irradiation feature of the new irradiator 15. It is also possible to obtain the light irradiation feature of the new irradiator 15 by reading out the module of information from the memory module 16 included in the new first light source module 7.

Moreover, the irradiator 15 and the memory module 16 may be configured so as to be arranged on the same substrate. Thus, the number of substrates to be installed when manufacturing the first light source module 7 becomes small and the assembly of the first light source module 7 becomes easy.

In addition, in one embodiment, the second light source module 8 may also be configured in the same way as that of the first light source 7, and thus, the same actions as those described above also arise in or may be performed with respect to the second light source 8.

According to the aforementioned embodiments, the following advantageous effects can be obtained.

<1> The light source module 7 (8), which may be a replacement unit for replacing a light source, is provided with the irradiator 15 (17), which is a light source, as well as the memory module 16 (18), which stores therein a module of information indicating a light irradiation feature of the irradiator 15 (17). Thus, even when there is an individual difference and/or a specification difference between a previous irradiator 15 (17) and a new irradiator 15 (17) after the replacement, it becomes unnecessary to update control data by learning the light irradiation feature of the new irradiator 15 after the replacement by actually driving the new irradiator 15. It becomes possible to shorten a period of time required for replacing the irradiator 15 (17) which is a light source with a new irradiator 15 (17).

Next, an embodiment of a liquid ejecting apparatus as well as a light source attachable to the liquid ejecting apparatus will be described with reference to FIGS. 5 and 6. In addition, this embodiment is different from other embodiments in a respect that, at the time of a replacement of light source module 7 (8), a module of information stored in the memory module 16 (18) included in a new light source module 7 (8) is copied into the driving controller 22. Further, the same constituent components as those previously described will be omitted from detailed description thereof.

Figure 5:
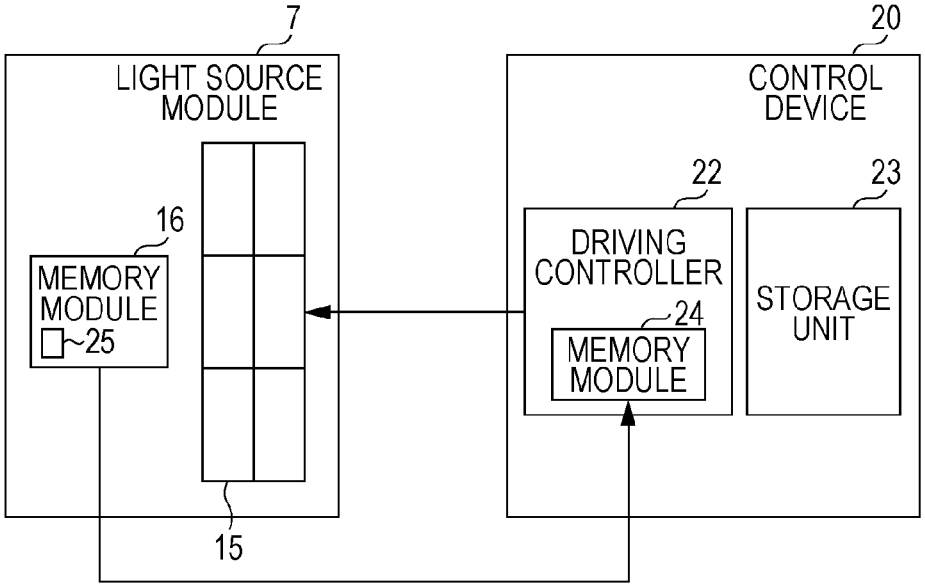
FIG. 5 is a block diagram schematically illustrating an embodiment of a control configuration of a light source in a printer.

As shown in FIG. 5, a nonvolatile memory module 24 may be provided in the driving controller 22 included in the control device 20. Further, the driving controller 22 performs copying processing for copying each of modules of information stored in a corresponding one of the memory module 16 and the memory module 18 into this memory module 24. Subsequently, the driving controller 22 performs control of each of the irradiator 15 and the irradiator 17 on the basis of a corresponding one of the modules of information having been copied into the memory module 24. That is, in this embodiment, each of the memory module 16 and the memory module 18 is equivalent to the first storage medium in which modules of information each indicating a light irradiation feature of a corresponding one of the irradiator 15 and the irradiator 17, which are light sources, are stored, and the memory module 24 is equivalent to the second storage medium. Thus, the memory module 24 stores a first module of information (copied from the memory module 16) for the irradiator 15 and the driving controller 22 controls the irradiator 15 based on that first module of information. The memory module 24 also stores a second module of information (copied from the memory module 18) for the irradiator 17 and the driving controller 22 controls the irradiator 17 based on that second module of information.

Further, a storage region 25 for use in a malfunction determination is provided in each of the memory module 16 and the memory module 18 which are included in the light source module 7 and the light source module 8, respectively. A block of predetermined data is inputted in advance in the storage region 25 for use in a malfunction determination.

Next, a series of example processes regarding copying processing for copying the module of information stored in the memory module 16 into the memory module 24 will be described with reference to a flowchart shown in FIG. 6. In addition, the copying processing for copying the module of information stored in the memory module 16 into the memory module 24 is the same as copying processing for copying the module of information stored in the memory module 18 into the memory module 24. Thus, hereinafter, description will be made by exemplifying the copying processing for copying the module of information stored in the memory module 16 into the memory module 24, and the copying processing for copying the module of information stored in the memory module 18 into the memory module 24 will be omitted from description. These two kinds of series of processes are each executed repeatedly by the control device 20 at predetermined intervals.

Figure 6:
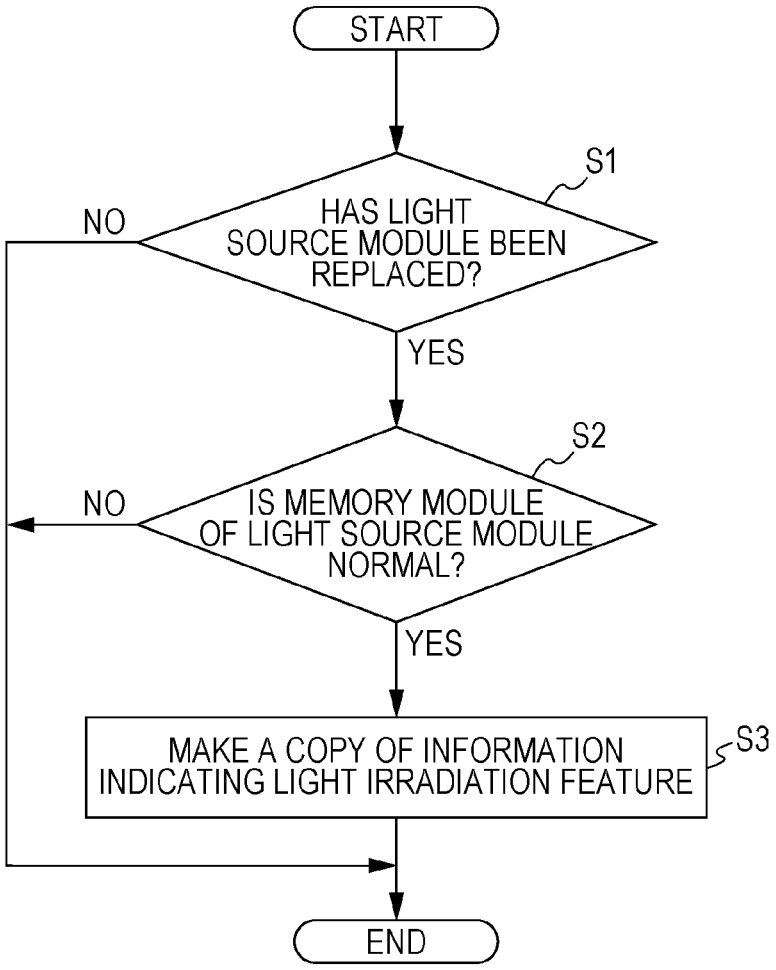
FIG. 6 is a flowchart illustrating an embodiment of a procedure of a series of processes associated with copying processing performed by a driving controller of a printer.

As shown in FIG. 6, in this series of processes it is first determined whether or not the first light source module 7 has been replaced (step S1). For example, the driving controller 22 is configured so as to perform writing of a pattern of data into the memory module 16 at intervals of a predetermined period longer than a period of intervals at which this process is performed. Further, in this process, in the case where there is not any pattern of data having been written by the driving control device 22 among pieces of data having been read out from the memory module 16, it is determined that the first light source module 7 has been replaced. In other words, the driving controller 22 may write certain data into the memory module 16. When the data (e.g., a pattern of data) is not found in the memory module 16, the driving controller 22 determines that the first light source module 7 has been replaced. In the case where a positive determination has been made in the process of step S1 (step S1: YES), that is, in the case where it has been determined that the first light source module 7 has been replaced and a new light source module is already attached, the process flow proceeds to step S2. Otherwise, the step S1 may be repeated.

In a process of step S2, it is determined whether or not the memory module 16 included in the first light source module 7 is normal. In this process, for example, in the case where a predetermined pattern of data, which is stored in advance in the storage region 25 which is for use in a malfunction determination and which is included in the memory module 16, can be normally read out, the memory module 16 is determined to be in a normal state. In other words, the storage region 25 should include or store a predetermined pattern of data. If the predetermined pattern of data can be read from the storage region 25, then the memory module 16 is determined to be normal and in a normal state. When the normal state is determined, the memory module 16 is not in a malfunction state. Further, in the case where a positive determination has been made in this process (step S2: YES), that is, in the case where the first light source module 7 has already been replaced, and that the memory module 16 is not in a malfunction state, the process flow proceeds to step S3.

In a process of step S3, the module of information indicating the light irradiation feature of the irradiator 15 is read out from the memory module 16 by the driving controller 22, and this module of information is copied into the memory module 24. When this copying process of copying the module of information indicating the light irradiation feature has been performed, this series of processes ends.

Meanwhile, in the case where a negative determination has been made in the process of step S1 or in the process of step S2, the copying process is not performed and this series of processes ends. In other words, the information indicating light irradiation features of the light source is not copied when it is determined that the light source module has not been replaced and/or the memory module is in a malfunction state.

Next, actions of the printer according to one embodiment will be described.

In one embodiment, under the state where the module of information stored in the memory module 16 included in the first light source module 7 is copied into the memory module 24 included in the driving controller 22, the irradiator 15 is controlled on the basis of the copied module of information stored in the memory module 24. Thus, the driving controller 22 does not need to, every time the driving controller 22 performs control of the irradiator 15, read out the module of information indicating the light irradiation feature from the memory module 16 included in the light source module 7, which is different from the driving controller 22 itself. Thus, even when the operation of reading out the module of information is difficult to perform because of, for example, an interruption of communication between the memory module 16 and the driving controller 22, the irradiator 15 can be appropriately controlled on the basis of the module of information that has been copied into the memory module 24.

Meanwhile, the temperature of the irradiator 15 becomes high when the irradiator 15 is driven. As a result, the memory module 16 included in the first light source module 7 is exposed to high temperatures. As a result, the operation of reading out the module of information from the memory module 16 is likely to be subjected to trouble due to the influence of heat caused by the high temperature.

In this regard, in one embodiment, at the time of the attachment of the first light source module 7, that is, before the memory module 16 is exposed to high temperatures associated with driving the irradiator 15, the module of information stored in the memory module 16 is copied into the memory module 24.

Further, when the memory module 16 becomes in or enters a malfunctions state, appropriate control of the irradiator 15 is likely difficult to perform. In this regard, in the aforementioned configuration, the storage region 25 for use in a malfunction determination is provided in the memory module 16. Thus, it is possible to determine whether or not the memory module 16 is in a malfunction state on the basis of a pattern of information stored in the storage region 25. Thus, the state of the memory module 16 (e.g., normal or malfunction) can be determined from the patter of information or data stored in the storage region 25. Moreover, the module of information stored in the memory module 16 is copied into the memory module 24 only when the memory module 16 is not in the malfunction state. Thus, it becomes possible to prevent the light source from being controlled on the basis of erroneous information.

In addition, as described above, driving the irradiator 15 causes the memory module 16 to be exposed to high temperatures. Thus, it is useful to employ, as the memory module 16, a memory module having high heat resistance, such as a magnetic RAM module. Further, in order to prevent the exposure of the memory module 16 to high temperatures, a heat shield material or a heat shield layer may be provided in a portion surrounding the memory module 16 or a cooling device for cooling the memory module 16 may be installed.

In addition, in one embodiment, a copying process of copying the module of information stored in the memory module 18 into the memory module 24 is performed in the same procedure as that of the copying process of copying the module of information stored in the memory module 16 into the memory module 24. Thus, with respect to the second light source module 8, the same actions as those described above arise and may be performed.

According to the aforementioned embodiment, besides the same advantageous effect as that in <1> described above, the following advantageous effects can be further obtained.

<2> A configuration is made such that, under the state where the module of information stored in the memory module 16 (18) included in the light source module 7 (8) is already copied into the memory module 24, the irradiator 15 (17) is controlled on the basis of the copied module of information in the memory module 24. Thus, even when the module of information is difficult to be read out from the memory module 16 (18) of the light source module 7 (8) due to an interruption of communication or the like, it is possible to appropriately perform control of the irradiator 15 (17). As a result, it is possible to improve the reliability of control of the irradiator 15 (17).

<3> When the light source module 7 (8) has been attached, the module of information stored in the memory module 16 (18) of the light source module 7 (8) is copied into the memory module 24. Thus, after a replacement of the irradiator 15 (17), the module of information is copied to the memory module 24 before the memory module 16 (18) is exposed to high temperature. Thus, the module of information is highly reliable when copied into the memory module 24 before being exposed to high temperatures. As a result, it is possible to further improve the reliability of control of the irradiator 15 (17).

<4> The storage region 25 provided in the memory module 16 (18) can be used to determine whether the memory module 16 (18) included in the light source module 7 (8) is in a malfunction state (e.g., adversely affected by heat such that the data stored in the memory module 16 (18) is not reliable). Thus, the module of information stored in the memory module 16 (18) is copied into the memory module 24 only when the memory module 16 (18) is not in a malfunction state. Thus, it is possible to further improve the reliability of control of the irradiator 15 (17).

In addition, the configurations of the aforementioned embodiments may be changed as follows.

In one embodiment, a configuration in which the storage region 25 for use in a malfunction determination is provided in the memory module 16 (18) of the light source module 7 (8) is adopted, but this configuration may be omitted. In a configuration resulting from making such a change, it is possible to obtain the same advantageous effects as those described in the above <1> to <3>. Further, the storage region 25 for use in a malfunction determination may be provided in any one of the memory module 16 and the memory module 18.

In one embodiment, the driving controller 22 is configured so as to cause the module of information stored in the memory module 16 (18) to be copied into the memory module 24 at the time of the attachment of the light source module 7 (8). However, a timing point or point in time when such a copy process is to be performed may be changed. That is, without being limited to such a timing point of the replacement of the light source module 7 (8), the module of information stored in the memory module 16 (18) may be copied into the memory module 24 at predetermined intervals. In a configuration resulting from making this change, it is possible to obtain the same advantageous effects as those described in the above <1> to <3>. In one example, the copying processes may be performed even if the memory module 16 (18) has been exposed to heat as long as the information stored in the memory module 16 (18) has not been affected by the heat and is reliable.

In some embodiments, a configuration in which the first light source module 7 and the second light source module 8 are provided is exemplified. Embodiments also include configurations where any one of these light source modules may be provided. Further, three or more light source modules may be provided.

In the aforementioned individual embodiments, the installation positions of the irradiator 15 (17) and the memory module 16 (18) in the light source module 7 (8) may be appropriately changed. That is, the installation positions of the irradiator 15 and the memory module 16 in the light source module 7 may be different from the installation positions of the irradiator 17 and the memory module 18 in the light source module 8.

In some embodiments, in the light source module 7 (8), the irradiator 15 (17) and the memory module 16 (18) may be each installed on a corresponding one of mutually different substrates. As a result, the irradiator 15 (17) and the memory module 16 (18) may be provided so as to be mutually isolated.

In some embodiments, an example in which relations between amounts of electric current and amounts of light are stored, as a module of information indicating a light irradiation feature, in the memory module 16 (18) included in the light source module 7 (8) has been exemplified. Nevertheless, a module of information indicating a light irradiation feature, stored in the memory module 16 (18), is not limited to such to this information. For example, relations or relationships between two other kinds of parameters, such as relations between voltage levels and amounts of light, relations between driving duty ratios and amounts of light in PWM control, and the like or combinations thereof may be stored. The memory module 16 (18) may store many different relations and each relation can be used when causing the light sources to irradiate.

In some embodiments, in the light source module 7 (8), a plurality of irradiators may be provided as a light source. For example, as a light source, a module in which a metal halide lamp and a UV-LED are provided together with each other may be employed, or a module in which a UV-LED cluster including a plurality of UV-LEDs may be employed.

In some embodiments, there is provided an example in which, as a liquid having a light hardening property, a UV ink, which becomes hardened by being irradiated with a UV light ray, is used However, it is possible to apply a technical concept, on the basis of which the aforementioned individual embodiments have been embodied, to a liquid ejecting apparatus employing an ink which becomes hardened by being irradiated with a light ray other than the UV light ray (for example, a visible light ray). This visible light ray has an amount of energy smaller than that of the UV light ray but has a light transparency level larger than that of the UV light ray. Thus, in the case where the thickness of a layer of an ink (liquid) which is adherent or which adheres to the paper P is larger, it is expected that the whole of the ink layer favorably becomes hardened without causing an unhardened portion to remain inside the ink layer.

In some embodiments, the liquid ejecting apparatus may be a liquid ejecting apparatus which ejects or discharges liquid other than ink. In addition, states of liquid which is discharged from a liquid ejecting apparatus and which is discharged in the form of liquid droplets each having a minute amount, include a grain-shaped liquid, a tear-shaped liquid and a thread-shaped liquid with a tail.

Further, a liquid used here may be any material which becomes hardened by being irradiated with light, such as UV, and further, which can be ejected from a liquid ejecting apparatus. For example, a liquid used here may be any material in the state of being in a liquid phase may be used. Embodiments encompasses a fluidal material, such as a liquid material having a high viscosity or high viscosity, sol, gel, gel water, other organic solvents, organic solvents, solutions, liquid resin, and liquid metal (metallic melt). As typical examples of liquid, ink, liquid crystal and the like, such as described in the aforementioned individual embodiments, can be given. Here, ink encompasses aqueous ink and oil ink, which are common, as well as liquid composites, such as gel ink and hot-melt ink. Specific examples of the liquid ejecting apparatus, include, for example, a liquid crystal display, an EL (electroluminescence) display, a surface emitting display, as well as a liquid ejecting apparatus which ejects a liquid containing, as a dispersed or melted material, materials, such as an electrode material and a color material, which are for use in manufacturing color filters, and the like. Further, specific examples of the liquid ejecting apparatus include a liquid ejecting apparatus which ejects living organic materials for use in manufacturing biotips, a liquid crystal apparatus which ejects liquids which become samples and are used as precision pipettes, print devices, micro-dispenser, and the like. Moreover, specific examples of the liquid ejecting apparatus include a liquid ejecting apparatus which ejects transparent resin liquid, such as ultraviolet hardening resin liquid, onto substrates in order to form micro-hemispherical lens (optical lens) and the like for use in optical communication components and the like.

What is claimed is:

1. A liquid ejecting apparatus comprising:

an ejecting head that ejects a liquid;

a light source module including a light source that irradiates light and a storage medium that stores therein information indicating a light irradiation feature of the light source;

an attaching portion to/from which the light source module is attachable/detachable; and a controller that performs control of the light source using the information indicating a light irradiation feature that is stored in the storage medium.

2. The liquid ejecting apparatus according to claim 1, wherein, a second storage medium is included in the controller, and wherein the controller makes a copy of the information indicating a light irradiation feature of the light module that is stored in the storage medium into the second storage medium, and performs control of the light source on information that has been copied into the second storage medium from the storage medium included in the light source module.

3. The liquid ejecting apparatus according to claim 2, wherein the controller copies the information stored in the storage medium into the second storage medium at a timing point when the light module is first attached to the attaching portion and before the storage medium is exposed to high temperatures.

4. The liquid ejecting apparatus according to claim 1, wherein the storage medium included in the light source module includes a storage area for use in determining a malfunction of the storage medium.

5. A light source module comprising:

a light source that irradiates light; and a storage medium that stores therein information indicating a light irradiation feature of the light source.

6. The light source module according to claim 5, wherein the storage medium is provided with a storage area for use in determining a malfunction of the storage medium.

* * * * *